United States Patent [19]

Moody

[11] Patent Number: 4,763,758

[45] Date of Patent: Aug. 16, 1988

[54] SCUFF PAD WITH STEP

[75] Inventor: Richard D. Moody, New Boston, N.H.

[73] Assignee: Plastic Techniques, Inc., Goffstown, N.H.

[21] Appl. No.: 944,583

[22] Filed: Dec. 22, 1986

[51] Int. Cl.[4] ..... B66F 11/04

[52] U.S. Cl. ..... 182/46; 182/2

[58] Field of Search ..... 182/2, 46

[56] References Cited

U.S. PATENT DOCUMENTS

| | | | |
|---|---|---|---|
| D. 244,453 | 5/1977 | Ohshiro | D25/2 |
| 3,005,512 | 10/1961 | Vogan | 182/2 |
| 3,022,854 | 2/1962 | Eckels | 182/2 |
| 3,169,602 | 2/1965 | Myers | 182/2 |
| 3,396,814 | 8/1968 | Garnett | 182/2 |
| 3,404,751 | 10/1968 | Nosworthy | 182/46 |
| 3,414,079 | 12/1968 | Wacht | 182/46 |
| 3,625,305 | 12/1971 | Mueller | 182/2 |
| 3,642,096 | 2/1972 | Valentine | 182/2 |
| 3,908,205 | 9/1975 | Chase | D25/2 |
| 4,252,215 | 2/1981 | Bell | 182/2 |
| 4,254,846 | 3/1981 | Soave | 182/2 |

*Primary Examiner*—Reinaldo P. Machado
*Attorney, Agent, or Firm*—R. Gale Rhodes, Jr.

[57] ABSTRACT

Scuff pad with step with which resides interiorly of an aerial lift bucket, or bucket liner if provided, at the bottom thereof and which includes a base portion and an upwardly extending portion extending upwardly of the base portion of a predetermined distance, the base portion has a top surface for being engaged by the shoes of said person upon standing in said bucket or liner to prevent scuffing, and the upwardly extending portion has a top surface providing a step which facilitates climbing out of said bucket or liner by the workman.

1 Claim, 1 Drawing Sheet

SCUFF PAD WITH STEP

FIELD OF THE INVENTION

This invention relates generally to the field of aerial lift buckets or baskets, and bucket liners therefor if provided, and more particularly, relates to a scuff pad with step for being inserted into the bottom of the aerial lift bucket or basket, or bucket liner if provided, for preventing scuffing of the inside bottom of the bucket or liner and for facilitating a workman's climbing out of the bucket or liner.

BACKGROUND OF THE INVENTION

Aerial lift buckets, sometimes referred to in the art as aerial lift baskets, are well known to the art for facilitating a workman's performance of work operation at elevated heights such as, for example, the installation and repair of electrical transmission lines or the trimming of trees around electrical transmission lines. In the performance of such work operations, there exists the constant danger of unwanted transmission of electrical current through the workman's body. To prevent this, as is also well known in the art, aerial lift buckets or baskets typically are made of electrically non-conductive material such as fiberglass, or fiberglass reinforced plastic, for insulation and for structural rigidity and wear. As a further safeguard, and as also known in the art, it is standard practice to employ a removable bucket liner of a non-conductive plastic material such as polyethylene which can be easily removed for periodic testing to confirm its insulative or dielectric properties. While similar tests can be performed on the aerial lift bucket or basket proper, the testing equipment normally cannot be reached by the aerial lift bucket trucks and it is a great deal simpler and easier to test only the bucket liners; defective bucket liners as contrasted with the more expensive aerial lift buckets or baskets are easily and cheaply replaced. Typical prior art aerial lift buckets or baskets, and liners, are disclosed in U.S. Pat. No. 3,005,512 issued Oct. 24, 1981 to R.R. Vogan (note outside aerial lift bucket or basket 23 of FIG. 2 and inside bucket liner 24 of FIG. 5); and in U.S. Pat. No. 3,404,751 issued October 8, 1968 to B.F. Nosworthy (note outside bucket or basket liner 14 and inside bucket liner 28 of FIG. 2).

Since, as noted, aerial lift buckets or baskets and bucket liners are typically made of fiberglass reinforced plastic or plastic, and since a workman residing in the bucket or liner typically wears heavy work shoes with rough soles, and since debris produced by the workman's work operations typically falls inside of and to the bottom of bucket or liner where it is ground into the bottom of the bucket or liner by the workman's shoes upon moving about in the bucket or liner, scuffing of the inside bottom of the bucket liner is produced which, as known, can wear a hole in the bottom of the bucket or liner, or at least produce small openings therein, which impair and even destroy the insulating or non-conductive quality of the bucket or liner. Accordingly, there exists a need in the aerial lift bucket art for apparatus for preventing such scuffing and destruction or impairment of the insulating or non-electrical conductive quality of the bucket or liner.

As is still further known in the art, for safety reasons, namely to reduce the likelihood that a workman working in the aerial lift bucket will inadvertently fall out while performing work functions including leaning out of the bucket, the depth of the aerial lift bucket, and hence the depth of an inserted bucket liner if provided, is such that a workman of average height will stand in the aerial lift bucket substantially up to his waist, or slightly above. This depth, as is further known to the art, makes it difficult for the workman to climb out of the aerial lift bucket both due to its depth and due to the fact that since the aerial lift bucket, and liner if provided, are made of a plastic, the inside surfaces of the bucket or liner are smooth providing no gripping surface to facilitate climbing out. Aerial lift buckets and bucket liners provided with steps for facilitating climbing out of a workman are known to the prior art, such as those disclosed in U.S. Pat. No. 3,169,602 to L. L. Myers issued Feb. 16, 1965; U.S. Pat. No. 3,396,814 to E.V. Garnett issued Aug. 13, 1968; U.S. Pat. No. 3,404,751 to B. F. Nosworthy issued Oct. 8, 1968; and U.S. Pat. No. 3,625,305 to Otto M. Mueller et al. issued Dec. 7, 1971. However, such prior art bucket liners and aerial lift buckets are not economically advantageous or desirable due to their difficulty, and thereby attendant expensiveness, of manufacture. Accordingly, there exists a need in the art for a less expensive apparatus for facilitating a workman's climbing out of an aerial lift bucket or bucket liner if provided.

SUMMARY OF THE INVENTION

The object of the present invention is to satisfy the foregoing two needs by providing in combination new and improved scruff pad and step for preventing scuffing of the bottom of the aerial lift bucket, or liner if provided, and for facilitating a workman's climbing out of the aerial lift bucket or bucket liner if provided.

The foregoing needs are satisfied by the scuff pad with step of the present invention which resides interiorly of an aerial lift bucket, or bucket liner if provided, at the bottom thereof and which includes a base portion and an upwardly extending portion extending upwardly of the base portion of a predetermined distance, the base portion has a top surface for being engaged by the shoes of said person upon standing in said bucket or liner to prevent scuffing, and the upwardly extending portion has a top surface providing a step which facilitates climbing out of said bucket or liner by the workman.

DESCRIPTION OF THE PREFERRED EMBODIMENT

Before describing the scuff pad with step of the present invention, the expression "aerial lift bucket apparatus" as used hereinafter, and in the appended claims, will be defined. As so used, the expression "aerial lift bucket apparatus" is used to describe an aerial lift bucket or aerial lift basket with, or without, a bucket liner which aerial lift bucket or aerial lift basket and liner is made of a material, typically fiber reinforced plastic or plastic, having the above-noted scuffing problem.

Figure 1:
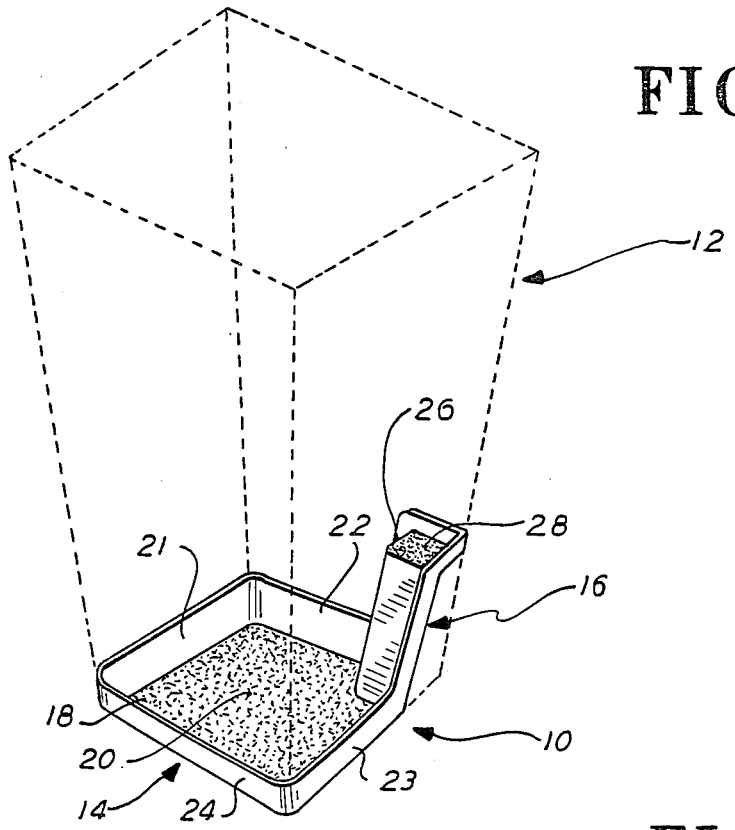
FIG. 1 is a diagrammatical illustration, in perspective, of a scuff pad with step embodying the present invention and shown residing interiorly at the bottom portion of aerial lift bucket apparatus shown in dashed outline and also shown in perspective.
Figure 3:
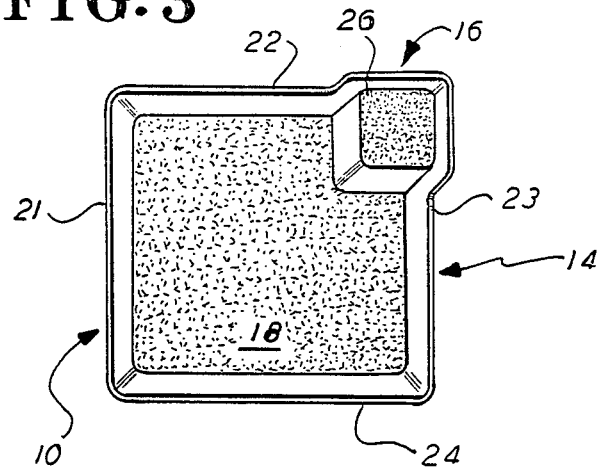
FIGS. 2, 3 and 4 are, respectively, front elevational, top and side elevational views of the scuff pad with step of the present invention.
Figure 4:
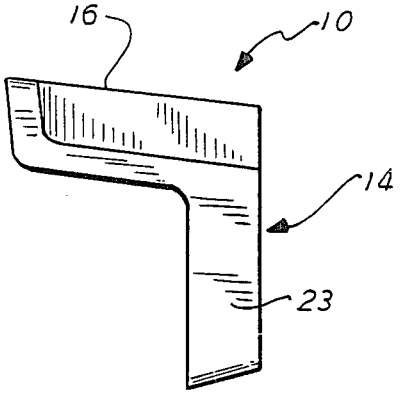
Figure 2:
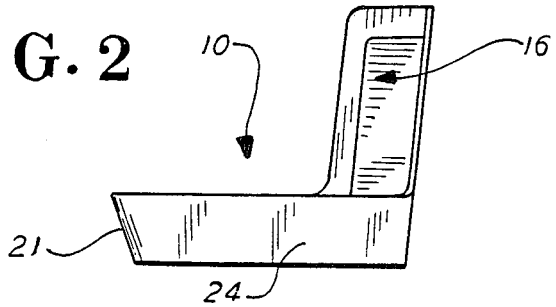

Referring now to FIG. 1, there is shown a scuff pad embodying the present invention and indicated by general numerical designation 10, and aerial lift bucket apparatus shown in dashed outline and indicated by general numerical designation 12. It will be understood that the scuff pad with step 10 is for residing interiorly of the bottom portion of the aerial lift bucket apparatus 12 and is generally of complementary configuration to the interior bottom portion of the aerial lift bucket apparatus; i.e. if the interior surfaces of the aerial lift bucket apparatus are tapered outwardly as shown and as is typical, the outer surfaces of the scruff pad with step will be tapered complementarily therewith.

Scuff pad with step 10 includes a base portion indicated by general numerical designation 14 and an upwardly extending portion indicated by general numerical designation 16 extending upwardly from the base portion. In the embodiment shown in FIG. 1, base portion 14 is of generally rectangular configuration and the upwardly extending portion 16 is formed integrally therewith at one corner thereof.

The base portion is provided with a top surface 18 for being engaged by the shoes of a workman residing in the aerial lift bucket apparatus 12 and for preventing the above-noted scuffing. To further facilitate this scuffing preventing, the top surface 18 may be provided with a suitable grit indicated diagrammatically by numerical designation 20 and which grit may be suitably adhesed to the top surface 18.

The base portion 14 may be provided with integrally formed and upwardly extending sides 21...24 which cooperate with the base portion 14 to provide a receptacle for receiving and collecting the above-noted debris produced during the workman's above-noted work operations. Thus, it will be understood that upon the removal of the scuff pad with step 10 from the aerial lift bucket apparatus 12 the collected debris is easily removed from the aerial lift bucket apparatus thereby eliminating the requirement of a workman to first climb out of the aerial lift bucket apparatus and then lean back over on his head into the aerial lift bucket apparatus to remove the debris.

The upwardly extending portion 16, as may be best noted by reference to FIG. 1, is provided with a top surface 26 providing a step for facilitating climbing out of the aerial lift bucket apparatus 12 by a workman; in an actual embodiment of the scuff pad with step of the present invention for use in aerial lift bucket apparatus having a depth of 39–42 inches, the upwardly extending portion 16 had a height of approximately 14 inches. Similar to the surface 18 of the bottom portion 14, the surface 26 may be also provided with a suitable grit indicated by numerical designation 28.

It has been found that by making the scuff pad with step 10 out of fiberglass the scuff pad with step will be suitably insulative or dielectric and will have sufficient structural rigidity to support the weight of a typical workman upon climbing out of the aerial lift bucket apparatus.

It will be further understood that many variations and modifications may be made in the present invention without departing from the spirit and the scope thereof.

What is claimed is:

1. Scuff pad with step for preventing scuffing of the inside bottom of aerial lift bucket apparatus and for facilitating a workman's climbing out of said aerial lift bucket apparatus, said aerial lift bucket apparatus having an interior or bottom portion comprising:

a body of predetermined material generally complementary in configuration to said interior bottom portion of said lift bucket apparatus and for residing interiorly of said aerial lift bucket apparatus at the bottom portion thereof, said body having a base portion and an upwardly extending portion extending upwardly of said base portion a predetermined distance;

said base portion being of generally rectangular configuration including at least one corner and having a top surface for being engaged by the shoes of said workman upon standing in said aerial lift bucket apparatus to prevent said scuffing; and said upwardly extending portion being formed integrally with said base portion and extending upwardly and inwardly thereof at said corner and having a top surface providing a step for facilitating said climbing out of said aerial lift bucket apparatus by said workman.

* * * * *